US006972397B2

(12) United States Patent
Ha

(10) Patent No.: US 6,972,397 B2
(45) Date of Patent: Dec. 6, 2005

(54) HEATING COOKER

(75) Inventor: Yu Jeub Ha, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/923,015

(22) Filed: Aug. 23, 2004

(65) Prior Publication Data

US 2005/0127061 A1 Jun. 16, 2005

(30) Foreign Application Priority Data

Dec. 16, 2003 (KR) ..... 10-2003-0092198

(51) Int. Cl.[7] ..... A61B 1/24; A47J 27/04
(52) U.S. Cl. ..... 219/401; 99/467; 126/20
(58) Field of Search ..... 219/401; 126/20, 126/20.1, 20.2; 99/467

(56) References Cited

U.S. PATENT DOCUMENTS 4,426,923 A * 1/1984 Ohata ..... 219/401
5,515,773 A * 5/1996 Bullard ..... 99/330
5,680,810 A * 10/1997 Sham ..... 99/330
6,100,502 A * 8/2000 Sham et al. ..... 219/401

FOREIGN PATENT DOCUMENTS

JP 08178289 A * 7/1996

OTHER PUBLICATIONS

K. Kazuo, High-Frequency Heating Apparatus, 56-162328 Patent Abstracts of Japan, Dec. 14, 1981, 2 pages.
Y. Masaaki, High-Frequency Heater, 08-178298 Patent Abstracts of Japan, Dec. 7, 1996, 2 pages.

* cited by examiner

*Primary Examiner*—Joseph Pelham
(74) *Attorney, Agent, or Firm*—Staas & Halsey LLP

(57) ABSTRACT

A heating cooker which prevents leakage of water even when an inlet of the water feed pipe is placed in any direction, and in which a water feed tank is removably coupled to the water feed pipe in any direction. The heating cooker includes a steam generator to supply steam into a cooking cavity defined in the heating cooker, a water feed tank to supply water into the steam generator, a water feed pipe to supply the water from the water feed tank into the steam generator, with the water feed tank removably coupled to the water feed pipe, a first valve to control an outlet provided on the water feed tank to discharge the water from the water feed tank, and a second valve to control an inlet provided on the water feed pipe to draw the water discharged from the water feed tank into the water feed pipe.

23 Claims, 4 Drawing Sheets

HEATING COOKER

CROSS-REFERENCE TO RELATED APPLICATIONS

This application claims the benefit of Korean Patent Application No. 2003-92198, filed Dec. 16, 2003 in the Korean Intellectual Property Office, the disclosure of which is incorporated herein by reference.

BACKGROUND OF THE INVENTION

1. Field of the Invention

The present invention relates, in general, to heating cookers and, more particularly, to a heating cooker having a water supplying structure in which a water feed tank is removably inserted into a front part of the heating cooker to supply water to a steam generator.

2. Description of the Related Art

Generally, heating cookers are cooking apparatuses which heat and cook food placed in a cooking cavity thereof. Exemplary conventional heating cookers include microwave ovens, electric ovens, gas ovens, etc. However, conventional heating cookers are disadvantageous in that food is cooked in a dry state while being heated in the cooking cavity, due to evaporation of water contained in the food. To solve the problems experienced in the conventional heating cookers a heating cooker having a steam generator to supply moisture into food, which is placed in the cooking cavity, by discharging steam into the cooking cavity has been proposed.

The steam generator of the conventional heating cooker includes a heater which is provided at a predetermined portion outside the cooking cavity to generate the steam, a water feed tank to supply water to the heater, and a water feed pipe to supply the water from the water feed tank to the heater, as proposed in Japan Patent Laid-open Publication No. Heisei. 08-178298 and No. sho. 56-162328. However, in the conventional heating cooker the water feed tank is coupled to the water feed pipe and an inlet, provided on an end of the water feed pipe, is opened. Therefore, when the end of the water feed pipe is moved in a predetermined direction, for example, when the end of the water feed pipe is horizontally moved in the heating cooker, water may undesirably leak from the inlet of the water feed pipe. Furthermore, the water feed pipe is installed in the conventional heating cooker so that the inlet of the water feed pipe is placed upward, thus the water feed tank must be removably vertically coupled to the inlet of the water feed pipe. Therefore, where the conventional heating cooker is placed on a shelf or a table, a user must pick up and put down the heavy water feed tank onto the heating cooker to couple the water feed tank to the water feed pipe.

SUMMARY OF THE INVENTION

Accordingly, an aspect of the present invention provides a heating cooker which prevents leakage of water even when an inlet of a water feed pipe is placed in any direction in the heating cooker, and in which a water feed tank is removably coupled to the water feed pipe in any direction.

Additional and/or other aspects and advantages of the invention will be set forth in part in the description which follows and, in part, will be obvious from the description, or may be learned by practice of the invention.

The above and/or other aspects are achieved by providing a heating cooker, including a steam generator to supply steam into a cooking cavity defined in the heating cooker, a water feed tank to supply water into the steam generator, a water feed pipe to supply the water from the water feed tank into the steam generator, with the water feed tank removably coupled to the water feed pipe, a first valve to control an outlet provided on the water feed tank to discharge the water from the water feed tank, and a second valve to control an inlet provided on the water feed pipe to draw the water discharged from the water feed tank into the water feed pipe.

In an aspect of the invention, the first and second valves are respectively opened while the water feed tank is coupled to the water feed pipe, and the first and second valves are respectively closed while the water feed tank is removed from the water feed pipe.

In another aspect of the invention, the first and second valves control each other to open or close the second and first valves.

In another aspect of the invention, the first valve includes a first valve body to control the outlet of the water feed tank by a reciprocating motion of the first valve body, and a first elastic unit to support the first valve body. The second valve includes a second valve body to control the inlet of the water feed pipe by a reciprocating motion of the second valve body, and a second elastic unit to support the second valve body.

In another aspect of the invention, the first and second valve bodies correspond to each other at outside ends of the first and second valve bodies.

In another aspect of the invention, the first elastic unit supports the first valve body toward an outside of the water feed tank, and the second elastic unit supports the second valve body toward an outside of the water feed pipe.

In another aspect of the invention, the first elastic unit has an elastic modulus higher than the second elastic unit.

In another aspect of the invention, each of the first and second elastic units is a compression spring.

In another aspect of the invention, the first valve body includes a first inside part provided at an inside of the outlet of the water feed tank, a first outside part provided at an outside of the outlet of the water feed tank, and a first intermediate part to connect the first inside part to the first outside part. The second valve body includes a second inside part provided at an inside of the inlet of the water feed pipe, a second outside part provided at an outside of the inlet of the water feed pipe, and a second intermediate part to connect the second inside part to the second outside part.

In another aspect of the invention, the heating cooker further includes a first packing provided on the first inside part of the first valve body to seal the outlet of the water feed tank, and a second packing provided on the second inside part of the second valve body to seal the inlet of the water feed pipe.

In another aspect of the invention, the heating cooker further includes a water path defined between the outlet of the water feed tank and the inlet of the water feed pipe to guide the water from the outlet to the inlet.

In another aspect of the invention, the water path is defined by an insert part extending from the water feed pipe.

In another aspect of the invention, the heating cooker further includes a third packing provided on the insert part of the water feed pipe to seal the water path defined by the insert part.

In another aspect of the invention, the water feed tank further includes a receiver to receive the insert part of the water feed pipe.

In another aspect of the invention, the receiver of the water feed tank is bent at an end thereof toward an axis of the receiver.

In another aspect of the invention, the outlet of the water feed tank and the inlet of the water feed pipe are provided to face each other in a horizontal direction, and the water feed tank may move to or away from the water feed pipe in the horizontal direction to be coupled to or removed from the water feed pipe.

In another aspect of the invention, the water feed tank is provided at a predetermined portion in a front part of the heating cooker.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
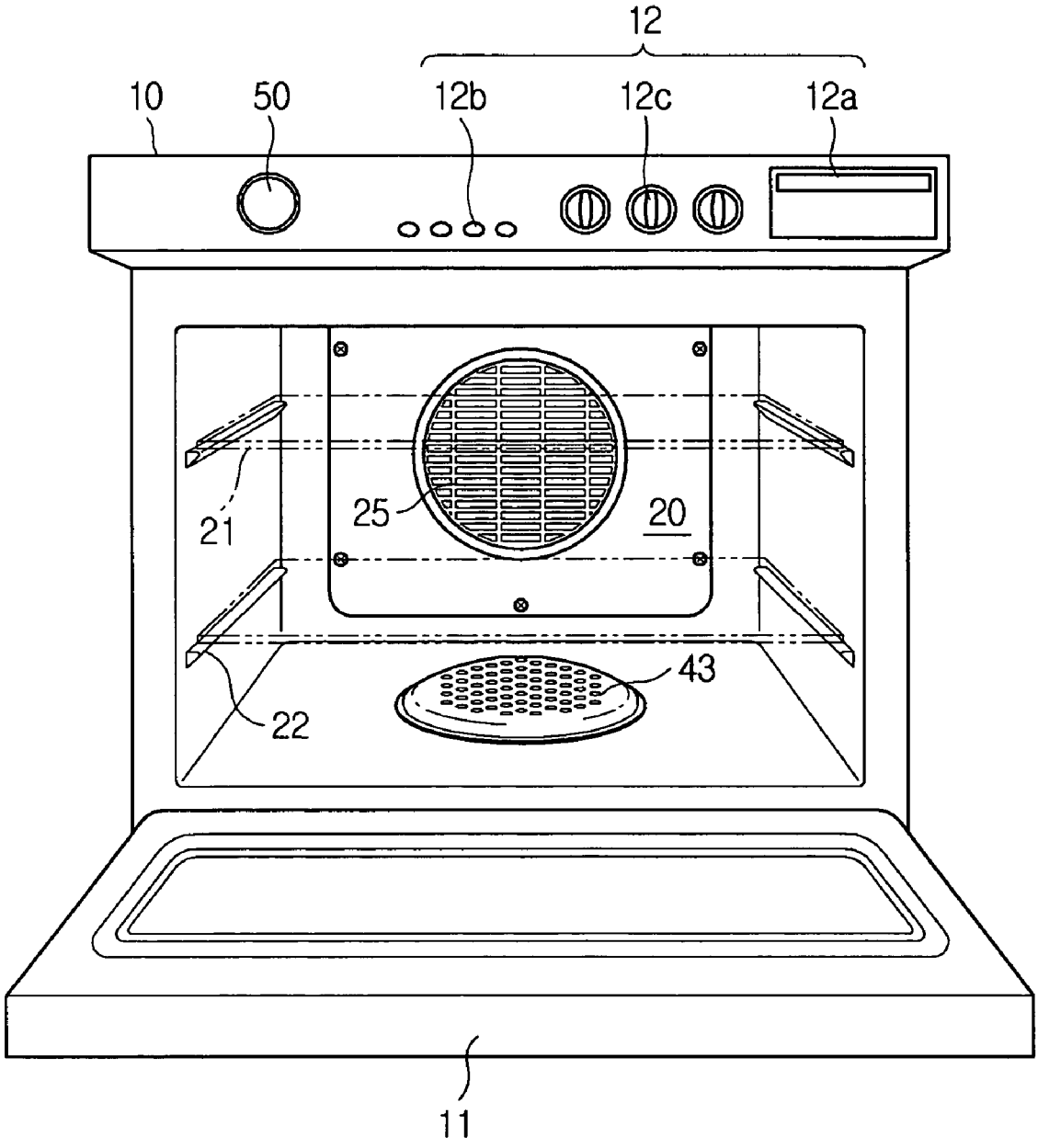
FIG. 1 is a front perspective view of a heating cooker, according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
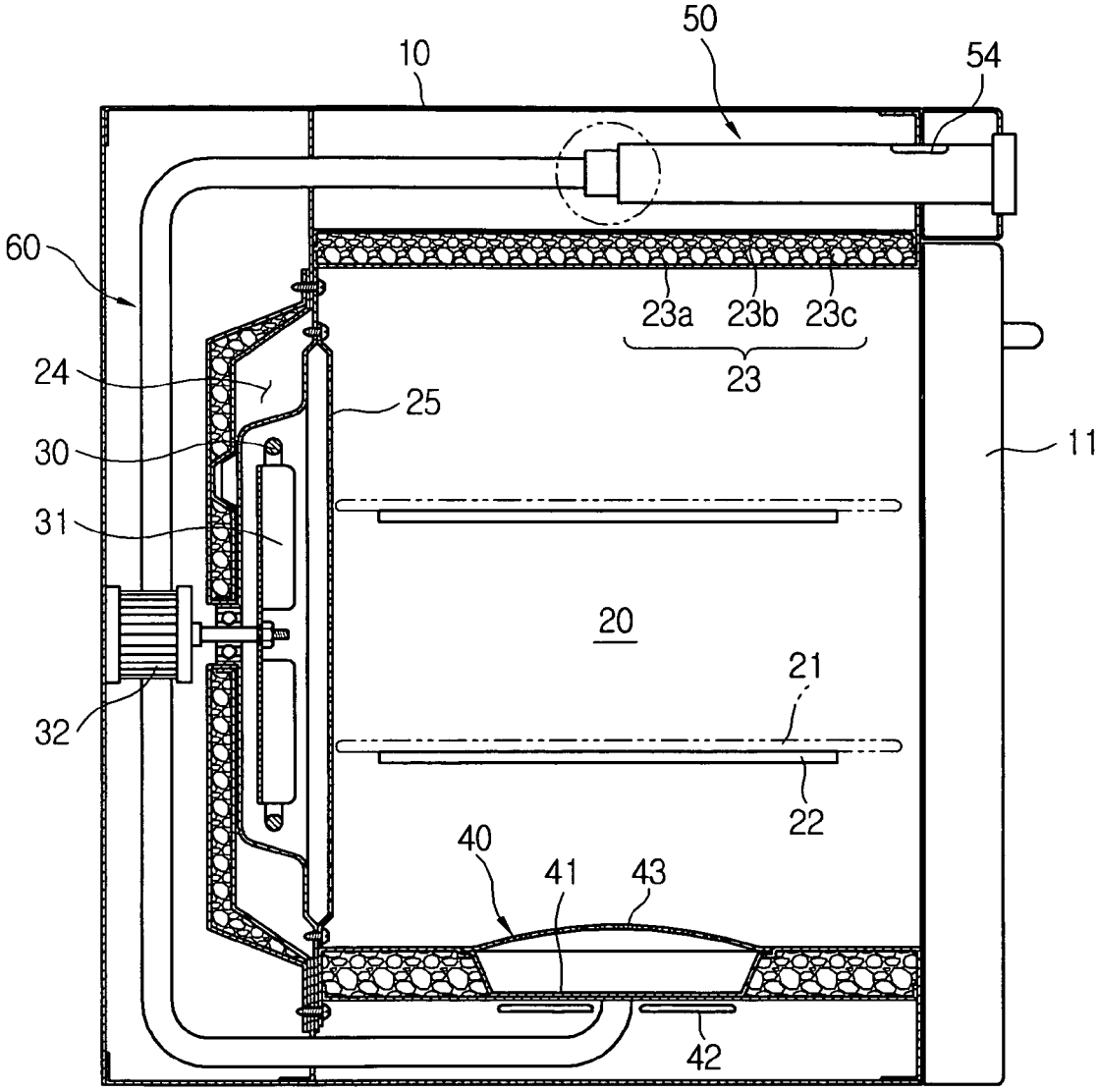
FIG. 2 is a side sectional view of the heating cooker of FIG. 1.

FIG. 1 is a front perspective view of a heating cooker 100, according to an embodiment of the present invention. FIG. 2 is a side sectional view of the heating cooker 100 of FIG. 1.

As shown in FIGS. 1 and 2, the heating cooker 100 according to the embodiment of the present invention includes a casing 10, a cooking cavity 20, which is defined in the casing 10, a first heater 30 to heat food which is placed in the cooking cavity 20, a fan 31 to circulate air within the cooking cavity 20, and a fan motor 32 to drive the fan 31. The heating cooker 100 further includes a steam generator 40 to supply steam into the cooking cavity 20, a water feed tank 50 to supply water into the steam generator 40, and a water feed pipe 60 to supply the water from the water feed tank 50 into the steam generator 40.

The heating cooker 100 further includes a door 11, which is attached to an open front of the casing 10, to rotate around a lower end of the door 11 so that the door 11 may be opened downward and closed upward at the open front of the casing 10. The heating cooker 100 further includes a controller 12 which is provided on a predetermined portion of a front surface of the casing 10 above the door 11 to allow a user to manipulate the heating cooker 100. The controller 12 includes a display 12*a* to display an operational state of the heating cooker 100 thereon, various control buttons 12*b*, and control switches 12*c*. The water feed tank 50 is inserted into a front of the casing 10 at a predetermined portion above the door 11 and opposite to the controller 12.

The cooking cavity 20 is opened at a front thereof to allow the user to place foods into and remove foods from the cooking cavity 20. The heating cooker 100 further includes a plurality of guide rails 22 which are oppositely provided on inner surfaces of both sidewalls of the cooking cavity 20 to correspond to each other. The guide rails 22 support opposite edges of upper and lower racks 21, on which foods are placed, and slide along the guide rails 22. The casing 10 includes a cavity wall 23, which is provided in the casing 10 to be separated from the casing 10, to define the cooking cavity 20 therein. The cavity wall 23 includes an inner wall 23*a* and an outer wall 23*b* in a double-layered structure. The cavity wall 23 further includes an insulating material 23*c* which fills a space between the inner wall 23*a* and the outer wall 23*b* to insulate the cooking cavity 20 from an outside of the cooking cavity 20.

The casing 10 further includes a recessed part 24, which is recessed rearward from an interior of the cooking cavity 20 to a predetermined depth on a rear wall of the cooking cavity 20. The first heater 30 and the fan 31 are installed in the recessed part 24. The heating cooker 100 further includes a perforated panel 25, which is provided at a front of the recessed part 24 to discharge heated air from the first heater 30 through the perforated panel 25 into the cooking cavity 20.

The steam generator 40 is provided on a bottom wall of the cooking cavity 20. The steam generator 40 includes a steam generating vessel 41 to contain water therein, a second heater 42 to heat the water contained in the steam generating vessel 41, and a vessel cover 43 which is provided on an upper portion of the steam generating vessel 41. A plurality of holes provided on the vessel cover 43 discharge the steam upward from the steam generating vessel 41 into the cooking cavity 20.

The water feed tank 50 is inserted at the predetermined portion in the front part of the casing 10 to be removably coupled to the water feed pipe 60. A construction of the water feed tank 50 will be described herein below.

The water feed tank 50 includes a tank 51 having a cylindrical shape and containing water therein. The water feed tank 50 further includes a receiver 52 which is provided on a rear end of the tank 51. The receiver 52 receives a front end of the water feed pipe 60 to couple the water feed tank 50 to the water feed pipe 60. The water feed tank 50 further includes an inlet 54 which is provided on a predetermined position of an upper portion of the tank 51 to supply water into the tank 51, and an outlet 53 which is provided on the rear end of the tank 51 to discharge the water from the tank 51 to the water feed pipe 60.

The heating cooker 100 further includes a first valve 70 to control the outlet 53 of the tank 51. The first valve 70 includes a first valve body 71 to control the outlet 53 of the tank 51 by a reciprocating motion of the first valve body 71. The first valve 70 further includes a first elastic unit 72 which is a compression spring provided at an outside of the tank 51 to elastically support the first valve body 71. The first valve body 71 includes a first inside part 71*a* which is provided at an inside of the tank 51, and a first outside part 71*b* which is provided at the outside of the tank 51 and is supported by the first elastic unit 72. The first valve body 71 further includes a first intermediate part 71*c* to connect the first inside part 71*a* to the first outside part 71*b*. The first valve body 71 further includes a first packing 73 which is provided on the first inside part 71*a* of the first valve body 71 to seal the outlet 53 of the tank 51.

Figure 4:
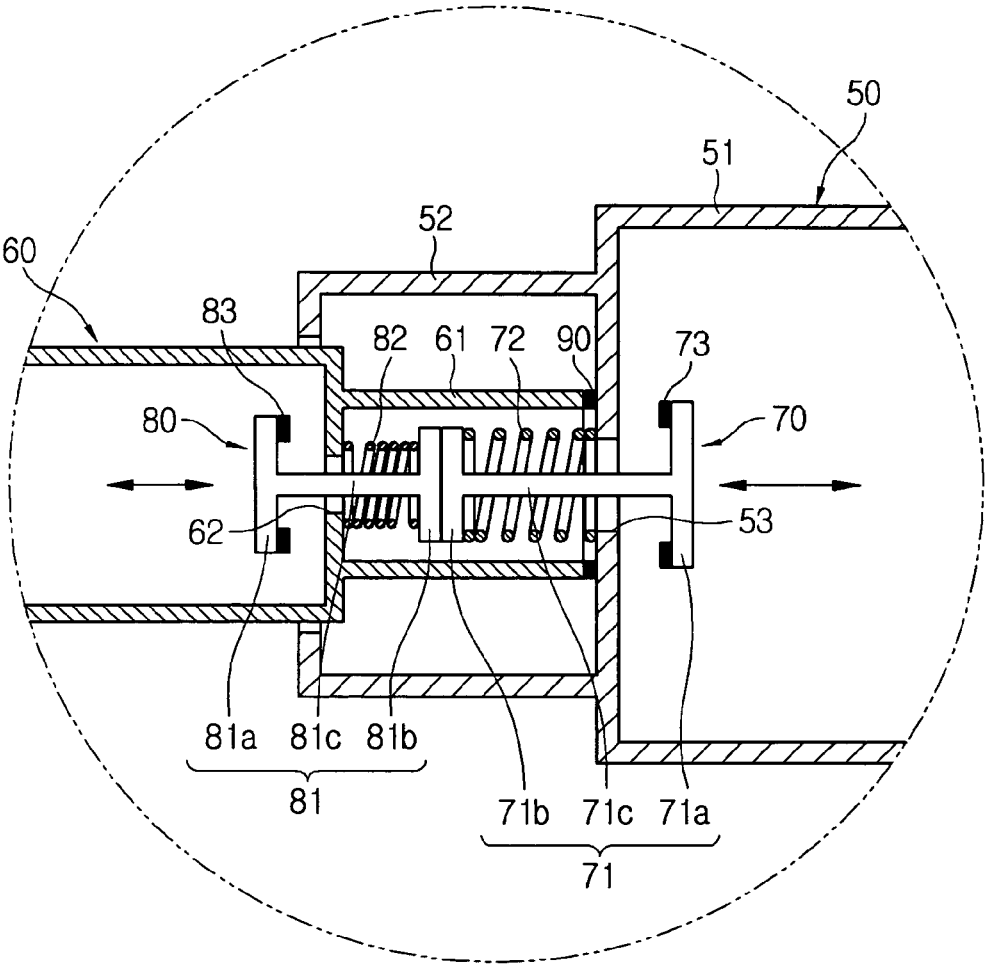
FIG. 4 is a partially enlarged sectional view of the water feed tank and the water feed pipe shown by the encircled portion of FIG. 2, in which an operation of the water feed tank relative to the water feed pipe is shown.

The water feed pipe 60 includes an inlet 62 which is provided on the front end of the water feed pipe 60 to draw the water discharged from the water feed tank 50. The water feed pipe 60 further includes an insert 61 which extends from the front end of the water feed pipe 60 toward the outlet 53 of the water feed tank 50. Thus, the insert 61 is inserted into the receiver 52 of the water feed tank 50 to define a water path between the outlet 53 of the water feed tank 50 and the inlet 62 of the water feed pipe 60. The heating cooker 100 further includes a second valve 80 to control the inlet 53 of the water feed pipe 60. The second valve 80 includes a second valve body 81, which includes a second inside part 81*a*, a second outside part 81*b* and a second intermediate part 81*c*, a second elastic unit 82 and a second packing 83, in a substantially similar, but oppositely facing, manner as that of the construction of the first valve 70. The water feed pipe 60 further includes a third packing 90, which is provided on a front end of the insert part 61 of the water feed pipe 60, to seal the water path defined by the insert part 61 when the water feed tank 50 is securely coupled to the water feed pipe 60 as shown in FIG. 4.

When the water feed tank 50 is coupled to the water feed pipe 60, the insert part 61 of the water feed pipe 60 is inserted into the receiver 52 of the water feed tank 50, so that the first outside part 71*b* of the first valve 70 and the second outside part 81*b* of the second valve 80 are in contact with each other to be compressed in opposite directions. In other words, when the first elastic unit 72 and the second elastic unit 82 are compressed, the first valve 70 and the second valve 80 open. Because the second elastic unit 82 has an elastic modulus lower than the first elastic unit 72, the second valve 80 is opened prior an opening of the first valve 70. The receiver 52 of the water feed tank 50 is bent at an end thereof toward an axis of the receiver 52 to prevent the water from leaking from the end of the receiver 52 while the water feed tank 50 is removed from the water feed pipe 60.

The operation and effect of the heating cooker 100 of the present invention will be described herein below.

First, foods are placed on at least one of the upper and lower racks 21 of the cooking cavity 20. Thereafter, the heating cooker 100 is operated so that the first heater 30 heats air in the cooking cavity 20. The air heated by the first heater 30 is circulated within the cooking cavity 20 by an operation of the fan 31 to the foods. When a time comes to supply steam into the cooking cavity 20, the water, contained in the steam generating vessel 41, is heated by the second heater 42 of the steam generator 40 to generate steam. The steam generated from the steam generator 40 is supplied into the cooking cavity 20.

Figure 3:
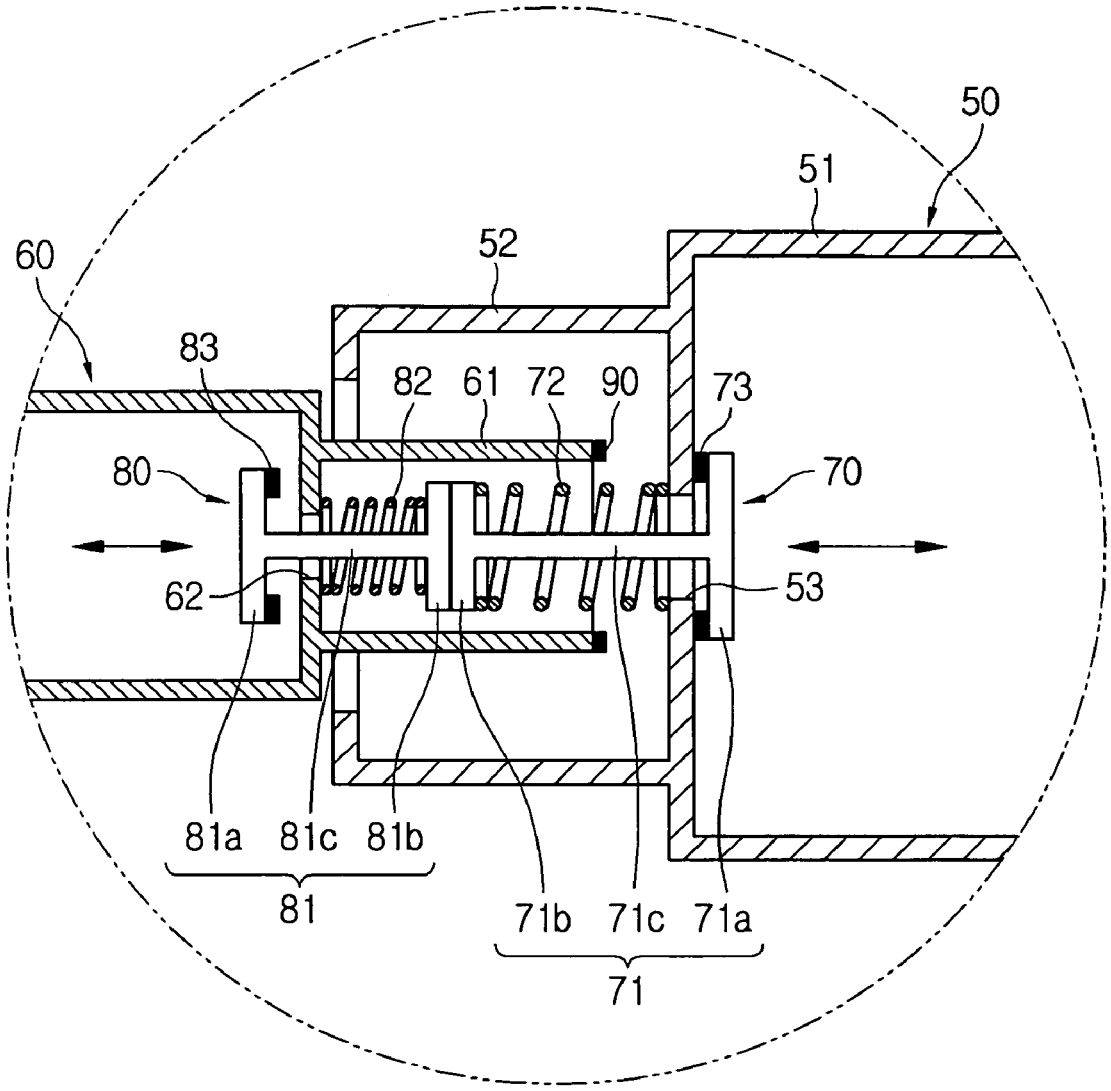
FIG. 3 is a partially enlarged sectional view of a water feed tank and a water feed pipe shown by an encircled portion of FIG. 2.

In order to feed water into the steam generator 40, the water feed tank 50, which contains water therein, is coupled to the water feed pipe 60. When the water feed tank 50 is separated from the water feed pipe 60 before the water feed tank 50 is coupled to the water feed pipe 60, the first and second valves 71 and 81 close the outlet 53 of the water feed tank 50 and the inlet 62 of the water feed pipe 60 by restoring forces of the first and second elastic units 72 and 82, respectively. When the water feed tank 50 is inserted into the casing 10 to be coupled to the water feed pipe 60, the first outside part 71*b* of the first valve 70 is in contact with the second outside part 81*b* of the second valve 80. When the water feed tank 50 is further inserted into the casing 10, the second valve 80 is opened prior to the opening of the first valve 70 because the elastic modulus of the second elastic unit 82 is lower than the elastic modulus of the first elastic unit 72, as shown in FIG. 3. Thereafter, when the water feed tank 50 is still further inserted into the casing 10, the first valve 70 also opens, as shown in FIG. 4, so that the water is discharged from the water feed tank 50 into the water feed pipe 60. Where the water feed tank 50 is fully inserted into the casing 10, the front end of the insert part 61 of the water feed pipe 60 is in contact with the rear end of the tank part 51 of the water feed tank 50, so that the water path passes through the outlet 53 of the water feed tank 50 and the inlet 62 of the water feed pipe 60. Thus, the water discharged from the tank part 51 is introduced into the water feed pipe 60 through the above-mentioned water path without substantial leakage.

When the water feed tank 50 is removed from the water feed pipe 60 to decouple the water feed tank 50 from the water feed pipe 60, the first valve 70 is primarily closed to stop the discharging of the water from the water feed tank 50. Thereafter, the second valve 80 is closed to prevent the water from flowing from the water feed pipe 50 in a reverse direction. Some water, which remains in the insert part 61 of the water feed pipe 60, then flows into the receiver 52 of the water feed tank 50. The water collected in the receiver 52 is drained to the outside of the casing 10 along with the water feed tank 50 when the water feed tank 50 is removed from the casing 10.

As is apparent from the above description, a heating cooker of the present invention includes a second valve to control an inlet of a water feed pipe. Therefore, even though the inlet of the water feed pipe is placed in the heating cooker in any direction, water contained in the water feed pipe does not leak from the inlet of the water feed pipe. Furthermore, a water feed tank moves to or away from the water feed pipe in a front part of a casing to be coupled to or removed from the water feed pipe, so that the structure of the heating cooker of the present invention is more convenient to a user because the user needs not pick up and put down the heavy water feed tank onto the casing to couple the water feed tank to the water feed pipe.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A heating cooker, comprising:

a steam generator to supply steam into a cooking cavity defined in the heating cooker;

a water feed tank to supply water into the steam generator;

a water feed pipe to supply the water from the water feed tank into the steam generator, with the water feed tank removably coupled to the water feed pipe;

a first valve to control an outlet provided on the water feed tank to discharge the water from the water feed tank; and a second valve to control an inlet provided on the water feed pipe to draw the water discharged from the water feed tank into the water feed pipe.

2. The heating cooker according to claim 1, wherein the first and second valves are respectively opened while the water feed tank is coupled to the water feed pipe, and the first and second valves are respectively closed while the water feed tank is removed from the water feed pipe.

3. The heating cooker according to claim 2, wherein the first and second valves control each other to open or close the second and first valves.

4. The heating cooker according to claim 1, wherein the first valve comprises:

a first valve body to control the outlet of the water feed tank; and a first elastic unit to support the first valve body, and the second valve comprises:

a second valve body to control the inlet of the water feed pipe; and a second elastic unit to support the second valve body.

5. The heating cooker according to claim 4, wherein the first and second valve bodies have respective corresponding locations at outside ends of the first and second valve bodies.

6. The heating cooker according to claim 5, wherein the first elastic unit supports the first valve body toward an outside of the water feed tank, and the second elastic unit supports the second valve body toward an outside of the water feed pipe.

7. The heating cooker according to claim 6, wherein the first elastic unit has an elastic modulus higher than the second elastic unit.

8. The heating cooker according to claim 7, wherein each of the first and second elastic units is a compression spring.

9. The heating cooker according to claim 8, wherein the first valve body comprises:

a first inside part at an inside of the outlet of the water feed tank;

a first outside part at an outside of the outlet of the water feed tank; and a first intermediate part to connect the first inside part to the first outside part, and the second valve body comprises:

a second inside part at an inside of the inlet of the water feed pipe;

a second outside part at an outside of the inlet of the water feed pipe; and a second intermediate part to connect the second inside part to the second outside part.

10. The heating cooker according to claim 9, further comprising:

a first packing on the first inside part of the first reciprocating valve body to seal the outlet of the water feed tank; and a second packing on the second inside part of the second reciprocating valve body to seal the inlet of the water feed pipe.

11. The heating cooker according to claim 1, further comprising:

a water path between the outlet of the water feed tank and the inlet of the water feed pipe to guide the water from the outlet to the inlet.

12. The heating cooker according to claim 11, wherein the water path comprises an insert part extending from the water feed pipe.

13. The heating cooker according to claim 12, further comprising:

a third packing provided on the insert part of the water feed pipe to seal the water path.

14. The heating cooker according to claim 13, wherein the water feed tank further comprises a receiver to receive the insert part of the water feed pipe.

15. The heating cooker according to claim 14, wherein the receiver of the water feed tank is bent at an end thereof toward a longitudinal axis of the receiver.

16. The heating cooker according to claim 15, wherein when the water feed tank is coupled to the water feed pipe, the insert part of the water feed pipe is inserted into the receiver so that the first outside part of the first valve and the second outside part of the second valve contact each other.

17. The heating cooker according to claim 15, wherein when the water feed tank is coupled to the water feed pipe, the insert part of the water feed pipe is inserted into the receiver so that the first outside part of the first valve and the second outside part of the second valve compress the first valve and the second valve in opposite directions.

18. The heating cooker according to claim 15, wherein when the water feed tank is separated from the water feed pipe before the water feed tank is coupled to the water feed pipe, the first and second valves close the outlet of the water feed tank and the inlet of the water feed pipe be restoring forces of the first and second elastic units.

19. The heating cooker according to claim 15, wherein, because the elastic modulus of the second elastic unit is lower than the elastic modulus of the first elastic unit, when the water feed tank is coupled to the water feed pipe, the second valve is opened prior to a moment when the first valve opens.

20. The heating cooker according to claim 19, wherein when the water feed tank is decoupled from the water feed pipe, the first valve is closed before the second valve is closed.

21. The heating cooker according to claim 20, wherein after the water feed tank is decoupled from the water feed pipe, water remaining in the insert part of the water feed pipe is drained.

22. The heating cooker according to claim 1, wherein the outlet of the water feed tank and the inlet of the water feed pipe face each other in a horizontal direction, and the water feed tank moves to or away from the water feed pipe in the horizontal direction to be coupled to or removed from the water feed pipe.

23. The heating cooker according to claim 22, wherein the water feed tank is provided at a predetermined portion in a front part of the heating cooker.

* * * * *